US005078917A

United States Patent [19]

Litt

[11] Patent Number: 5,078,917

[45] Date of Patent: Jan. 7, 1992

[54] WHITE OIL POUR POINT DEPRESSANTS

[75] Inventor: Fredric A. Litt, University Heights, Ohio

[73] Assignee: Functional Products Incorporated, Cleveland, Ohio

[21] Appl. No.: 430,518

[22] Filed: Nov. 1, 1989

[51] Int. Cl.[5] ..... C10M 145/08

[52] U.S. Cl. ..... 252/56 S; 252/56 R

[58] Field of Search ..... 252/56 R, 52 R, 56 S

[56] References Cited

U.S. PATENT DOCUMENTS

| | | | |
|---|---|---|---|
| 2,499,723 | 3/1950 | Coffman et al. | 252/56 R |
| 3,048,479 | 8/1962 | Ilnyckyj et al. | 44/62 |
| 3,250,714 | 5/1966 | Ilnyckyj et al. | 252/56 |
| 3,262,873 | 7/1966 | Tiedje et al. | 208/33 |
| 3,304,261 | 2/1967 | Ilnyckyj et al. | 252/56 R |
| 3,453,211 | 7/1969 | Phillips | 252/56 R |
| 3,467,597 | 9/1969 | Tunkel et al. | 252/56 |
| 3,567,639 | 3/1971 | Aaron | 252/56 R |
| 3,955,940 | 5/1976 | Hollyday | 44/62 |
| 4,556,499 | 12/1985 | Heier | 252/51.5 A |
| 4,862,908 | 9/1989 | Payer | 44/62 |

FOREIGN PATENT DOCUMENTS

| | | | |
|---|---|---|---|
| 17166 | 5/1962 | Japan | 252/56 R |
| 886804 | 1/1962 | United Kingdom | 252/56 R |

*Primary Examiner*—Prince Willis, Jr.
*Assistant Examiner*—Ellen McAvoy
*Attorney, Agent, or Firm*—D. Peter Hochberg; Mark Kusner; Louis J. Weisz

[57] ABSTRACT

Pour point depressants for white oils and combinations of them with white oils are disclosed. The pour point depressants comprise ethylene-vinyl acetate copolymers, including terpolymers containing ethylene and vinyl acetate.

15 Claims, No Drawings

WHITE OIL POUR POINT DEPRESSANTS

TECHNICAL FIELD

This invention relates to white oils, and to additives for improving their physical properties. More particularly, this invention relates to the preparation of white oils that exhibit lower pour point characteristics and that are, therefore, easier to handle at low temperatures. Specifically, this invention relates to white oils to which certain ethylene-vinyl acetate copolymers have been added to lower their pour points.

BACKGROUND OF THE INVENTION

Not infrequently, the processing and handling of food, and food products, involves the application of oils thereto, or the processing of such foods in close proximity with such oils. In the case of grain handling, for example, the kernels are normally associated with relatively large amounts of finely-divided, dust-producing particles. When suspended in air in particular amounts, such dust is flammable to the point of being violently explosive, and many disasters involving extensive damage to property, as well as the loss of life have been attributed to dust explosions. As a result, extensive precautions are normally taken when handling grains and other finely subdivided foods and food products to remove sources of ignition from the vicinity thereof, and particularly to minimize dusting involving such particles.

Further with respect to such dusting, grain being transported by conveyors is frequently subjected to dust suppression measures, for example, to processing procedures in which the grain is sprayed with atomized oil droplets that display relatively long-lasting, dust-suppressing effects.

While any of a variety of oils can be successfully employed for dust suppression purposes, of equal or possibly greater concern is the problem of foodstuff contamination. In this connection, the Federal Food and Drug Administration, F.D.A., has enacted regulations that prohibit the inclusion of a variety of materials in foodstuffs, either in the form of direct or indirect additives, unless the materials have been specifically approved by the Agency for use with foodstuffs. Most mineral oils fall within such prohibition, and as a consequence, resort is oftentimes had to the use of vegetable oils, for example, soybean oils, in spraying grain for dust-suppression purposes. Although such oils are effective for dust-suppression, they have an unfortunate tendency to become rancid, and thus to adversely affect the quality of the grains with which they are combined. Vegetable oils may also have poor "handling" properties at low temperatures.

In view of the risk of rancidity, so-called "white oils" have also been used for dust suppression. White oils are essentially colorless, odorless, and tasteless mineral oils produced, for example, by the rigorous treatment of light industrial oils with substances such as fuming sulfuric acid, and subsequent extraction with caustic soda. Among other things, the treatment results in the removal of aromatics and olefins from such oils, and the resulting products are relatively non-reactive with many chemicals. Consequently, white oils are widely used in the food, drug, and cosmetic industries due to their non-staining properties, as well as their inertness, and particularly because of their freedom from toxic effects.

White oils have a significant drawback, however, important in certain situations, in that they exhibit relatively high pour points as a result of the substantial amounts of wax contained in the oils. The wax present tends to leave solution when the oils are cooled, resulting in increased viscosity and making the oils difficult to handle, particularly at lower temperatures. While white oils derived from naphthenic mineral oils contain somewhat less wax than those produced from paraffinic materials, even the former oils can contain 10% or more wax, on a weight basis.

For reasons that include a desire to desirably lower their pour points to facilitate low-temperature handling, ordinary mineral oils are typically subjected to dewaxing procedures involving the addition of certain materials, termed dewaxing "aids", to the oils. These assist in the filtration of wax particles precipitated during wax-removing, chilling procedures by reducing the size of the precipitated particles, thus making them easier to filter. Such treatment is not feasible for white oils, however, because of their market applications in the food area, and the fact that such aids have not received approval of the F.D.A., and could at least in part remain in the oil following the wax-removal step.

As a consequence of the difficulty of removing wax from white oils, such oils typically exhibit relatively high pour points compared with ordinary industrial mineral oils. For example, in the case of oils derived from naphthenic stocks, the oils have pour points in the order of about −20° F., compared to about −60° F. for ordinary industrial oils, and in the case of oils processed from paraffinic feed stocks, about +20° F. for the white oils, compared with the pour points of similar industrial oils, which can be as low as about −10° F.

Another approach used in enhancing the low-temperature handling characteristics of ordinary mineral oils involves the use of "flow improvers," or pour point depressants. These include, for example, high molecular weight compositions formed by the alkylation of benzene, or derivatives thereof, by the polymerization of lower molecular weight methacrylates, or by condensation polymerizations involving compounds of various kinds. However, as in the case of dewaxing aids, the use of such materials has ordinarily been avoided insofar as white oils destined for use in association with foodstuffs are concerned, because of the lack of F.D.A. approvals.

Furthermore, because of the costs entailed in the treatment to which the white oils have been subjected during their formation, there is a natural reluctance to separate and discard wax, which if allowed to remain adds to the volume of the oils and, therefore, to the revenues derived from their sale.

Ethylene-vinyl acetate copolymers have in the past been used as pour point depressants in petroleum products other than white oils, and since such copolymers have received certain approvals for use in contact with foodstuffs, having been determined by the F.D.A to be highly nontoxic, the use of such copolymers with oils intended for human consumption has certain attractions.

However, while such copolymers have been used as pour point depressants in connection with middle distillate petroleum fractions such as diesel fuel, kerosene, heating oils, turbo-jet fuels and the like, they have not been used for, or recognized to be useful for desirably lowering the pour point of mineral oils. To the contrary, various art references including U.S. Pat. Nos. 3,048,479; 3,250,714 and 3,262,873 assert that while the copolymers effectively lower the pour point of middle distillate hydrocarbons, they have no similar effect on mineral-based lubricating oils, and in fact, are ineffective for such purpose. Furthermore, while some ethylene-vinyl acetate copolymers have been used as viscosity index improvers for industrial oils, they have not been used in connection with white oils as pour point depressants.

DISCLOSURE OF THE INVENTION

In view of the preceding, therefore, it is a first aspect of this invention to desirably reduce the pour point of white oils.

A second aspect of this invention is to provide white oils with desirable low-temperature handling characteristics.

Another aspect of this invention is to furnish a white oil pour point depressant additive of a type determined by the F.D.A. to be highly non-toxic.

An additional aspect of this invention is to supply a dust suppression oil that is not subject to rancidity.

A further aspect of this invention is to provide an oil useful in the suppression of dust unavoidably generated during the movement of particulate substances.

The foregoing and other aspects of the invention are provided by the method of lowering the pour point of white oils by incorporating therein a polymer prepared from monomeric constituents that include vinyl acetate and ethylene, the weight ratio of vinyl acetate to ethylene in said polymer being from about 25 vinyl acetate to about 75 ethylene; to about 55 vinyl acetate to about 45 ethylene.

The foregoing and still further aspects of the invention are provided by a composition comprising a mixture of a white oil and a polymer made from monomeric constituents that include vinyl acetate and ethylene, the weight ratio of vinyl acetate to ethylene in said polymer being from about 25 vinyl acetate to about 75 ethylene; to about 55 vinyl acetate to about 45 ethylene.

The foregoing and yet other aspects of the invention are provided by a concentrated additive for lowering the pour point of a diluent by addition thereto, comprising a mixture of white oil and a polymer made from monomeric constituents that include vinyl acetate and ethylene, the weight ratio of vinyl acetate to ethylene in said polymer being from about 25 vinyl acetate to about 75 ethylene; to about 55 vinyl acetate to about 45 ethylene, wherein said polymer constitutes from about 15% to about 80%, on a weight basis, of the white oil present in said additive.

DETAILED DESCRIPTION OF THE INVENTION

A wide variety of compounds have been used in the past as pour point depressants for lubricating oils. Such materials are commonly prepared either by condensing aromatic compounds with long chain paraffins such as wax, or by condensing olefinic esters. In addition, certain copolymer pour point depressants comprising ethylene-vinyl acetate copolymers have been successfully used to provide pour point depression for middle distillate and lighter fuels, in general, those oils boiling in the range from about 250° to 750° F. Such middle distillates include heating oils, diesel fuel oils, kerosene, jet fuels, and the like. U.S. Pat. No. 3,048,479 describes the use of ethylene-vinyl acetate copolymers for such use; however, the inventors therein have observed in the patent that, surprisingly, these low molecular weight copolymers have no effect on the pour points of lubricating oils, thus emphasizing the difference in the structure between the wax associated with lube oils, on the one hand, and with middle distillates on the other. Notwithstanding such observation, and contrary to what might have been expected, it has now been found that ethylene-vinyl acetate copolymers are, in fact, effective as pour point depressants when added to white oils. The discovery is all the more surprising since white oils are produced from the same petroleum fractions as lubricating oils.

As previously stated, white oils are prepared by drastically treating, for example highly sulfonating or deeply extracting industrial oils to produce hydrocarbons having moderate viscosities, low volatilities, and high flash points. While not wishing to be bound by the theory, it is believed that such refining procedures produce an oil that behaves differently from the precursor oil from which it is made.

Whatever the explanation for the ability of the ethylene-vinyl acetate materials described herein to lower the pour point of white oils, it has been found that ethylene-vinyl acetate copolymers, and certain terpolymers that include ethylene and vinyl acetate, have the ability to dramatically lower the pour points of white oils with which they are combined, greatly facilitating the handling of white oils at lower temperatures.

While ethylene-vinyl acetate copolymers are much preferred insofar as pour point depression of white oils is concerned, terpolymers containing ethylene and vinyl acetate together with a third monomer such as, for example, acrylic acid, methyl acrylate, methyl methacrylate, methacrylic acid, ethyl acrylate, propylene, alpha-olefins, and various other monomers, may also be effectively used for lowering the pour point of white oils.

It has been found that when ethylene and vinyl acetate are incorporated in white oils so that the concentration of such constituents present in the copolymer, or the terpolymer, as the case may be, constitute on a combined weight basis from about 0.01% to about 1.0% of the white oil, significant pour point depression is realized. In a preferred embodiment, the combined amount of ethylene and vinyl acetate present in the white oil will range from about 0.06% to about 0.5%, by weight.

Although the weight ratio of vinyl acetate to ethylene in the polymers may be varied, it is preferable that the weight ratio of vinyl acetate to ethylene in the polymer, whether the polymer is a copolymer, the preferred material, or a terpolymer, should be from about 25 vinyl acetate to about 75 ethylene; to about 55 vinyl acetate to about 45 ethylene.

Stated another way, it is desirable that the amount of vinyl acetate present range from about 1 mole of vinyl acetate for every 3 moles of ethylene; to about 1 mole of vinyl acetate for every 10 moles of ethylene incorporated in the additive polymer.

It has been found that the number average molecular weight of the ethylene-vinyl acetate-containing polymer may vary within a fairly broad range; however, particularly in the case of the ethylene-vinyl acetate copolymers, the polymer will have a number average molecular weight of from about 500 to about 10,000, with a number average molecular weight of from about 1,000 to 5,000 being preferred.

The ethylene-vinyl acetate polymers can be made in a variety of ways well known in the art, for example, those described in U.S. Pat. No. 2,200,429, in which ethylene is reacted with vinyl acetate at temperatures in the range of 100° to 400° C., and pressures in excess of 500 atmospheres; or by reacting ethylene with vinyl acetate in an aqueous medium in the presence of a peroxy compound catalyst, as disclosed in U.S. Pat. Nos. 2,334,195; 2,388,178, 2,396,677 and 2,391,920.

Still other methods of making ethylene-vinyl acetate copolymers, and of making terpolymers containing ethylene and vinyl acetate, are well-known in the art, and may be used in producing the pour point depressants of the invention.

The degree of polymerization of commercial ethylene-vinyl acetates is commonly characterized by melt viscosities rather than by molecular weight. Melt viscosities are ordinarily expressed as Brookfield viscosities, measured by ASTM D 3236 at a specific temperature, often 140° C. for ethylene-vinyl acetate containing materials. In some instances the melt viscosity is also given in units of "melt index," as determined by test ASTM B-1238, the flow-rate being observed in a standard apparatus.

Suitable ethylene-vinyl acetate copolymers include, for example, that manufactured by Dupont under the trademark "Elvax 40W," said to contain about 39% to 42% by weight vinyl acetate, and to have a melt index of from about 48 to 66; that manufactured by Allied-Signal under the trademark "AC-430," which the manufacturer indicates contains about 26% vinyl acetate, and to have a Brookfield viscosity of about 600 centipoise at 140° C.; and the ethylene vinyl acetate sold by Quantum Chemical Company under the trademark "VYNATHENE-939-00," described by the manufacturer as containing about 39% vinyl acetate, and to have a Brookfield viscosity of 115 centipoise at 140° C. However, various other similar ethylene-vinyl acetate compounds are equally useful in lowering the pour points of white oils when combined therewith.

Among the white oils with which the pour point depressants disclosed herein are effective as pour point depressants are those comprising a mixture of liquid hydrocarbons, essentially paraffinic and naphthenic in nature, obtained from petroleum. The oil is refined to meet the test requirements of the United States Pharmacopeia XX (1980) for readily carbonizable substances (page 532). Such oils will also meet the test requirements of U.S.P. XVII for sulfur compounds (page 400), and will conform to the specifications described in the "Journal of the Association of Official Analytical Chemists" Vol. 45, page 66 (1962), after correction of the ultraviolet absorbance for any absorbance due to any added ontioxidants. The white mineral oils may also contain any antioxidant permitted in food by regulations issued in accordance with Section 409 of the Federal Food, Drug, and Cosmetic Act.

White mineral oils suitable for use with the pour point depressants of the invention are those meeting the specifications prescribed in Section 172.878 of the referred-to-Act, as well as technical white mineral oil consisting of specially refined distillates of virgin petroleum, or of specially refined distillates that meet the specifications of Section 178.3620.

All of the preceding reference authorities are to be considered incorporated herein by reference. Other white oils may also be used, however, as well as those specifically described in the preceding.

In employing the ethylene-vinyl acetate polymers of the invention as pour point depressants, the polymers may be added directly to the white oil, or a concentrate may be prepared and added to the white oil. This concentrate may then be regarded as an oil additive. Depending upon its molecular weight, the ethylene-vinyl acetate will either be in the form of a paste or a solid, which is usually heated following its addition to the white oil to facilitate its incorporation therein. In instances where an additive is to be formed for subsequent addition to the white oil, relatively large amounts of the ethylene-vinyl acetate are added to relatively small portions of white oil, for example, producing a white oil/ethylene-vinyl acetate mixture containing from about 15% to about 80% by weight of ethylene-vinyl acetate. The white oil is often heated, for instance, to from about 120° F. to 150° F. and stirred during the addition of the ethylene-vinyl acetate polymer to accelerate formation of the desired mixture. Alternatively, diluents other than white oil may be used in preparing the concentrate. Other suitable diluents include vegetable oils, other liquids that are non-toxic and soluble in the white oil to be treated, and mixtures of the preceding.

The following examples, while not intended to be limiting in nature, are illustrative of the invention.

In the examples, pour points were measured by ASTM D 97. Specific directions for performing the test are to be found in standard references; however, generally the test involves the use of a test tube 30 mm in diameter, by 4 inches long, into which the sample to be tested is placed, and the tube sealed with a stopper. A thermometer is introduced into the test tube through a hole in the stopper until the bulb is immersed in the sample, the level of the oil being even with a marker-line inscribed on the tube. The tube is then heated above the temperature of interest, and subsequently cooled and periodically tipped to determine whether the liquid in the test tube is capable of movement, i.e., flow away from the thermometer. The pour point is the lowest temperature at which liquid movement is still observable.

A series of ethylene-vinyl acetate additives are made up as follows:

ADDITIVE 1

30 grams of Dupont's "ELVAX 40W," a commercial ethylene-vinyl acetate product containing from 39% to 42%, by weight, of vinyl acetate and having a melt index of between 48 and 66 grams per 10 seconds, is dissolved in 70 grams of Amoco 5 NF white mineral oil.

ADDITIVE 2

30 grams of Allied-Signal "AC-430," a commercial ethylene-vinyl acetate copolymer product containing about 26%, by weight, of vinyl acetate and having a Brookfield viscosity of 600 centipoise at 140° C., is dissolved in 70 grams of Amoco 5 NF white mineral oil.

ADDITIVE 3

30 grams of Quantum Chemical Company "Vynathene EY-939-00," a commercial ethylene-vinyl acetate copolymer product containing about 39%, by weight, of vinyl acetate and having a Brookfield viscosity of 115 centipoise at 140° C., is dissolved in 70 grams of Amoco 5 NF white mineral oil.

ADDITIVE 4

30 grams of U.S.I. "CRL-1447," an ethylene-vinyl acetate copolymer supplied by Quantum Chemical Company containing about 32%, by weight, of vinyl acetate and having a Brookfield viscosity of 120 centipoise at 140° C.,, is dissolved in 70 grams of Amocco 5 NF white mineral oil.

ADDITIVE 5

30 grams of U.S.I. "CRL-1448," an ethylene-vinyl acetate copolymer supplied by Quantum Chemical Company containing 37%, by weight, of vinyl acetate, and having a Brookfield viscosity of 150 centipoise at 140° C., is dissolved in 70 grams of Amoco 5 NF white mineral oil.

ADDITIVE 6

30 grams of U.S.I. "CRL-1449, " an ethylene-vinyl acetate copolymer supplied by Quantum Chemical Company containing 39%, by weight, vinyl acetate, and having a Brookfield viscosity of 450 centipoise at 140° C., is dissolved in 70 grams of Amoco 5 NF white mineral oil.

ADDITIVE 7

30 grams of Allied Signal "ACX-440, " an ethylene vinyl acetate copolymer supplied by Allied Signal containing 40%, by weight, vinyl acetate, and having a Brookfield viscosity of 350 centipoise at 140° C., is dissolved in 70 grams of Amoco 5 NF white mineral oil.

The additives described are tested in blends of white mineral oil, and in an industrial oil base stock control as follows:

EXAMPLE 1

In a test of the efficiency of the additives on the depression of pour points in Amoco 5 NF white mineral oil, a series of test solutions of this mineral oil, containing the additives described, are prepared and examined for pour point depression with the following results:

TABLE 1

| Additive | Ethylene-Vinyl Acetate Content (Wt %) | Pour Point (°F.) | Pour Pt. Lowering (°F.) |
|---|---|---|---|
| None | — | +20 | — |
| Additive #1 | 0.2 | −5 | 25 |
| Additive #1 | 0.5 | −15 | 35 |
| Additive #2 | 0.2 | −10 | 30 |
| Additive #3 | 0.2 | −15 | 35 |
| Additive #4 | 0.2 | −5 | 25 |
| Additive #5 | 0.2 | −5 | 25 |
| Additive #6 | 0.2 | −10 | 30 |
| Additive #7 | 0.2 | −10 | 30 |

The pour point depression obtained ranges from 25 to 35 degrees Fahrenheit, depending upon the amount and type of additive introduced. The lowering of the pour points obtained is both significant and markedly superior to those obtained with an ordinary lubricating base oil, as is hereinafter described.

EXAMPLE 2

In a further test, the pour point lowering effect of various additives is tested by incorporating the additives in a white mineral oil designated by Amoco as "68 USP." Pour point lowering is experienced as follows:

TABLE 2

| Additive | Ethylene-Vinyl Acetate Content (Wt %) | Pour Point (°F.) | Pour Pt. Lowering (°F.) |
|---|---|---|---|
| None | — | +30 | |
| Additive #1 | 0.5 | +15 | 15 |
| Additive #1 | 1.0 | +15 | 15 |
| Additive #2 | 0.5 | +20 | 10 |
| Additive #3 | 0.2 | +15 | 15 |
| Additive #3 | 1.0 | +5 | 25 |

The results obtained, although not as impressive as those described in Table 1, are nevertheless commercially significant and would have a beneficial effect on the handling characteristics of the white oils at lower temperatures.

EXAMPLE 3

In a still further experiment, various of the additives described are added to Witco's "Carnation" white mineral oil. The pour points of the prepared samples are examined and found to be as follows:

TABLE 3

| Additive | Ethylene-Vinyl Acetate Content (Wt %) | Pour Point (°F.) | Pour Pt. Lowering (°F.) |
|---|---|---|---|
| None | — | +25 | |
| Additive #1 | 0.2 | 0 | 25 |
| Additive #1 | 0.5 | −5 | 30 |
| Additive #2 | 0.2 | −5 | 30 |
| Additive #3 | 0.2 | −10 | 35 |

Again, the results demonstrate the significant pour point lowering that the ethylene-vinyl acetate additives produce in white oils, the pour points ranging from 25° to 35° F. lower than in the case in which the white mineral oils contain none of the additives.

EXAMPLE 4

In a control experiment designed to measure the pour point lowering effect of the additives on ordinary lubricating base oils other than of the white oil type, different additives are combined with Pennzoil ISO 32 base oil. The results are as follows:

TABLE 4

| Additive | Ethylene-Vinyl Acetate Content (Wt %) | Pour Point (°F.) | Pour Pt. Lowering (°F.) |
|---|---|---|---|
| None | — | −5 | |
| Additive #1 | 0.25 | −5 | 0 |
| Additive #2 | 0.25 | −5 | 0 |
| Additive #3 | 0.25 | −10 | 5 |

The fact that no useful pour point lowering is experienced clearly demonstrates the difference between the effect of the ethylene-vinyl acetate materials on white oils, relative to its effect on ordinary lubricating oils. The experiment, therefore, underscores the significantly different characteristics of ordinary lubricating oils, compared to white oils.

While in accordance with the patent statutes, a preferred mode and best embodiment has been presented, the scope of the invention is not limited thereto, but rather is measured by the scope of the attached claims.

What is claimed is:

1. The method of lowering the pour point of white oils by incorporating therein a polymer prepared from monomeric constituents comprising vinyl acetate and ethylene, the weight ratio of vinyl acetate to ethylene in said polymer being from about 25 vinyl acetate to about 75 ethylene; to about 55 vinyl acetate to about 45 ethylene.

2. The method of claim 1 wherein said polymer is an ethylene-vinyl acetate copolymer.

3. The method of claim 2 wherein the number average molecular weight of said copolymer is from about 500 to about 10,000.

4. The method of claim 3 wherein said copolymer equals from about 0.01% to about 1.0%, by weight, of said white oil.

5. The method of claim 1 wherein said polymer is a terpolymer prepared from monomers that include ethylene and vinyl acetate.

6. The method of claim 5 wherein said ethylene and said vinyl acetate in said terpolymer together equal from about 0.01% to about 1.0%, by weight, of said white oil.

7. The method of claim 5 wherein the third monomer employed to prepare said terpolymer is a member selected from a group of acrylic acid, methyl acrylate, methyl methacrylate, methacrylic acid, ethyl acrylate, and an alpha-olefin.

8. A composition comprising a mixture of white oil and a polymer made from monomeric constituents that include vinyl acetate and ethylene, the weight ratio of vinyl acetate to ethylene in said polymer being from about 25 vinyl acetate to about 75 ethylene; to about 55 vinyl acetate to about 45 ethylene.

9. The composition of claim 8 wherein said polymer is an ethylene-vinyl acetate copolymer.

10. The composition of claim 9 wherein the number average molecular weight of said copolymer is from about 500 to about 10,000.

11. The composition of claim 10 wherein said copolymer equals from about 0.01% to about 1.0%, by weight, of said white oil.

12. A composition of claim 8 wherein said polymer is a terpolymer prepared from monomers that include ethylene and vinyl acetate.

13. The composition of claim 12 wherein said ethylene and said vinyl acetate together equal from about 0.01% to about 1.0%, by weight of said white oil.

14. The composition of claim 12 wherein the third monomer employed to prepare said terpolymer is a member selected from the group of acrylic acid, methyl acrylate, methyl methacrylate, methacrylic acid, ethyl acrylate, and an alpha-olefin.

15. A concentrated additive for lowering the pour point of white oils by addition of the additive thereto comprising a mixture of a white oil diluent and an ethylene-vinyl acetate copolymer, the weight ratio of vinyl acetate to ethylene in said copolymer being from about 25 vinyl acetate to about 75 ethylene; to about 55 vinyl acetate to about 45 ethylene, wherein said copolymer constitutes from about 15% to about 80%, on a weight basis, of the white oil present in said additive.

* * * * *